US006574811B1

(12) United States Patent
Mossbeck

(10) Patent No.: US 6,574,811 B1
(45) Date of Patent: Jun. 10, 2003

(54) POCKETED SPRING ASSEMBLY AND ASSOCIATED METHOD

(75) Inventor: Niels S. Mossbeck, Carthage, MO (US)

(73) Assignee: L & P Property Management Company, South Gate, CA (US)

( * ) Notice: Subject to any disclaimer, the term of this patent is extended or adjusted under 35 U.S.C. 154(b) by 73 days.

This patent is subject to a terminal disclaimer.

(21) Appl. No.: 09/671,081

(22) Filed: Sep. 27, 2000

Related U.S. Application Data

(63) Continuation-in-part of application No. 09/207,441, filed on Dec. 8, 1998, now Pat. No. 6,295,673.
(60) Provisional application No. 60/094,135, filed on Jul. 24, 1998.

(51) Int. Cl.[7] ..... A47C 27/07
(52) U.S. Cl. ..... 5/655.8; 5/716; 5/720
(58) Field of Search ..... 5/655.8, 716, 720, 5/230, 655.7; 156/182, 263, 297, 301

(56) References Cited

U.S. PATENT DOCUMENTS

| | | | | |
|---|---|---|---|---|
| 2,296,807 A | | 9/1942 | Cavaler | 5/353 |
| 2,862,214 A | | 12/1958 | Thompson et al. | 5/353 |
| 3,633,228 A | | 1/1972 | Zysman | 5/353 |
| 4,234,983 A | | 11/1980 | Stumpf | 5/477 |
| 4,401,501 A | | 8/1983 | Stumpf | 156/367 |
| 4,485,506 A | | 12/1984 | Stumpf et al. | 5/477 |
| 4,566,926 A | | 1/1986 | Stumpf | 156/165 |
| 4,578,834 A | * | 4/1986 | Stumpf | 156/291 |
| 4,854,023 A | | 8/1989 | Stumpf | |
| 4,907,309 A | | 3/1990 | Breckle | 5/477 |
| 4,986,518 A | | 1/1991 | Stumpf | |
| 5,016,304 A | | 5/1991 | Ryhiner | 5/453 |
| 5,016,305 A | | 5/1991 | Suenens et al. | 5/477 |
| 5,126,004 A | | 6/1992 | Suenens et al. | 156/556 |
| 5,127,635 A | | 7/1992 | Long et al. | 267/91 |
| 5,319,815 A | | 6/1994 | Stumpf et al. | 5/477 |
| 5,362,546 A | * | 11/1994 | Boulanger | 156/160 |
| 5,637,178 A | | 6/1997 | Suenens et al. | 156/297 |
| 5,749,133 A | * | 5/1998 | Mauldin et al. | 29/430 |
| 5,885,407 A | * | 3/1999 | Mossbeck | 156/558 |
| 6,175,997 B1 | * | 1/2001 | Mossbeck | 29/91 |
| 6,176,960 B1 | * | 1/2001 | Mossbeck et al. | 156/291 |
| 6,176,961 B1 | * | 1/2001 | Mossbeck et al. | 156/291 |

FOREIGN PATENT DOCUMENTS

| | | |
|---|---|---|
| DE | 4031652 | 4/1992 |
| DE | 4040220 | 6/1992 |
| DE | 9214732 | 7/1994 |
| DE | 29902911 | 6/1999 |
| EP | 0089789 | 9/1983 |
| EP | 0357912 | 3/1990 |
| EP | 0985369 | 3/2000 |
| FR | 1475098 | 2/1967 |
| FR | 2076465 | 10/1971 |

* cited by examiner

*Primary Examiner*—Teri Pham Luu
*Assistant Examiner*—Fredrick Conley
(74) *Attorney, Agent, or Firm*—Wood, Herron & Evans, LLP

(57) ABSTRACT

A method of assembling strings of pocketed coil springs into an innerspring assembly which may be used as the core of a mattress, cushion or similar body support foundation uses a fabric material, preferably having an adhesive component, between rows of pocketed coil springs. The adhesive material serves to bond the rows of springs to each other and to position them relative to one another to prevent expansion and/or contraction of the spring assembly.

28 Claims, 5 Drawing Sheets

POCKETED SPRING ASSEMBLY AND ASSOCIATED METHOD

This is a continuation in part of co-pending U.S. application Ser. No. 09/207,441, filed Dec. 8, 1998 now U.S. Pat. No. 6,295,673, which pursuant to 37 C.F.R. §1.78(a)(4) claimed the benefit of and priority to prior filed Provisional Application Serial No. 60/094,135, filed Jul. 24, 1998, each of which are expressly incorporated herein by reference.

FIELD OF THE INVENTION

This invention relates to pocketed spring assemblies for mattress cores and the like and to a method of assembling pocket coil spring assemblies.

BACKGROUND OF THE INVENTION

It is known to place strings of pocketed or encased coil springs in a parallel fashion to create a mattress, inner spring assembly or other body support foundation. A known method for making the strings of encased coil springs is to fold the encasing or pocketing material such that there is a crease on one longitudinal side and an opening on the opposite side. Compressed coils are inserted through the opening between the layers of pocketing material and the opening is sealed by a sealing system, such as a thermal sealing system or stitching. The layers of pocketing material are further sealed between each coil. The coils are than turned and expanded such that one end of the coil is facing the crease of the pocketing material and the other end is facing the sealed opening.

The number of coils in a string or row and the number of rows are dependent upon the coil spring diameter and the desired finished size of the mattress or the like. The construction of the mattress core may include a plurality of rows of parallel coils with the coils aligned in columns so that the coils line up in both longitudinal and lateral directions, or they may be nested in a honeycomb configuration wherein coils in one row are off-set from coils in the adjacent row.

It is known to connect the strings of coils in a coil to coil manner by applying an adhesive to the encased coils as illustrated in Stumpf U.S. Pat. Nos. 4,566,926 and 4,578,834 and Suenens et al. Nos. 5,016,305 and 5,637,178, each of which are hereby incorporated by reference. Nested constructions where strings of coils are interlocked are illustrated in Stumpf U.S. Pat. No. 5,319,815 and German 4,040,220, each of which are hereby incorporated by reference. Other methods of connecting the strings of coils utilize metal clips known as hog rings or they may be stitched with twine which penetrates each string of coils.

Another method in the prior art is the use of strings of coils positioned in a frame with a web of nonwoven material on the top and bottom of the pocketed coil units. Alternatively, or in addition, beads of hot melt adhesive may be dispensed onto the top and bottom surfaces of the strings of coils and a sheet of nonwoven material pressed against the adhesive containing surfaces.

In the prior art processes, control and distribution of the adhesive is difficult and inefficient. Some areas of the coil strings may receive too much adhesive while other areas may not receive a sufficient amount of adhesive. Excess adhesive of course is economically inefficient, while risk of separation of the pocketed coil strings from the nonwoven material may result from too little adhesive. Moreover, when adhesive is sprayed there is a tendency for the spray nozzles to clog so that the flow of glue is obstructed. This results in a time consuming cleaning and maintenance program.

Additionally, hot melt spraying requires the system to be heated about one hour before spraying can begin. Other difficulties presented by hot melt spraying and application of beads is that the hoses through which the hot melt flows must be insulated to maintain the temperature of the glue within the hose, thereby resulting in very heavy hoses. If the spraying process involves manually moving the spray nozzle to which the hose is attached to spray the adhesive, the heavy hoses result in the process being slow and fatiguing to the operators who often encounter minor burns from the glue and the nozzles.

A potential solution for at least some of the above-described disadvantages is disclosed in this inventor's pending U.S. patent application Ser. No. 09/024,536, filed Feb. 17, 1998, and hereby incorporated by reference in its entirety. In that method, the plurality of strings of pocketed coil springs are placed between top and bottom sheets of nonwoven webs of material, each web having a heat activated reinforcement netting. Thus, the strings are attached at their upper and lower surfaces to the sheets of material, rather than on their side surfaces to an adjacent string.

A problem that exists in many prior art processes is the tendency of the rows of pocketed coil springs to expand and contract in the longitudinal direction of the string which causes a deformation or inconsistent sizing of the spring assembly. Even though the adjacent strings of pocketed coil springs are adhesively bonded, connected or otherwise joined together, slack in the fabric of the individual or collective strings allows the spring assembly to expand and contract and thereby produce an inconsistently sized or dimensioned spring assembly as a result of manufacturing production of pocketed coil spring assemblies. In other words, spring assemblies having the same number of pocketed springs and the same number of strings of pocketed springs may be larger or smaller than similar units. This presents difficulties in the production of mattresses and the like utilizing such spring assemblies.

One attempt to minimize this deformation problem has been to cover the spring assembly on the top and/or bottom of the springs as previously described. However, while this approach may minimize the deformation or dimensional inconsistency of the spring assembly, it also inhibits the individual deflection of the various coil springs in the pockets. As a result, certain benefits which are afforded by a pocketed coil spring assembly are not available with this approach to solving the deformation problem.

SUMMARY OF THE INVENTION

The present invention provides a spring assembly, and a method for making the same, having a layer of preferably fabric material which may or may not include an adhesive component between strings of pocketed coil springs, thus serving to adhere the strings to each other while reducing or preventing wear between coils in frictional relation. According to the principles of the present invention, the fabric layer may be added to one or both sides of the pocketing material during the encasing process. The strings of pocketed coil springs are assembled in side-by-side relation and the adhesive component of the fabric material is activated, thereby bonding the strings together. A feasible and economic method for adhering strings of pocketed coil springs together in a spring assembly is provided. Further, a significant advantage of a presently preferred method and resulting spring assembly according to this invention is the ability to consistently size the spring assembly by tautening the fabric material or netting which is positioned between the adjacent strings.

The fabric material or adhesive netting, which is interposed between the adjacent strings of pocketed coil springs, has low stretching properties and when it is pulled taut and adhered or bonded to facing surfaces of the strings, it minimizes, reduces and/or eliminates the tendency for the strings and resulting spring assembly to expand and/or contract in the longitudinal direction of the strings. The layer which is interposed bet ween the adjacent strings may comprise, according to one presently preferred embodiment of this invention, a netting of adhesive which, when activated, is bonded to each of the confronting surfaces of the adjacent strings of pocketed coil springs to thereby form the spring assembly and minimize or prevent the pocketed coil springs in each string from moving toward or away from one another and the resulting contraction or expansion of the spring assembly in that direction. The layer of fabric, netting or material which is interposed between the strings and pulled taut may be formed of a nonwoven, woven or knitted fabric. The layer itself may include an adhesive component according to one embodiment of this invention or adhesive may be added to bond the layer and adjacent strings together.

BRIEF DESCRIPTION OF THE DRAWINGS

The particular features and advantages of the invention as well as other objects will become apparent from the following description taken in connection with the accompanying drawings in which.

DESCRIPTION OF PREFERRED EMBODIMENTS

Figure 1:
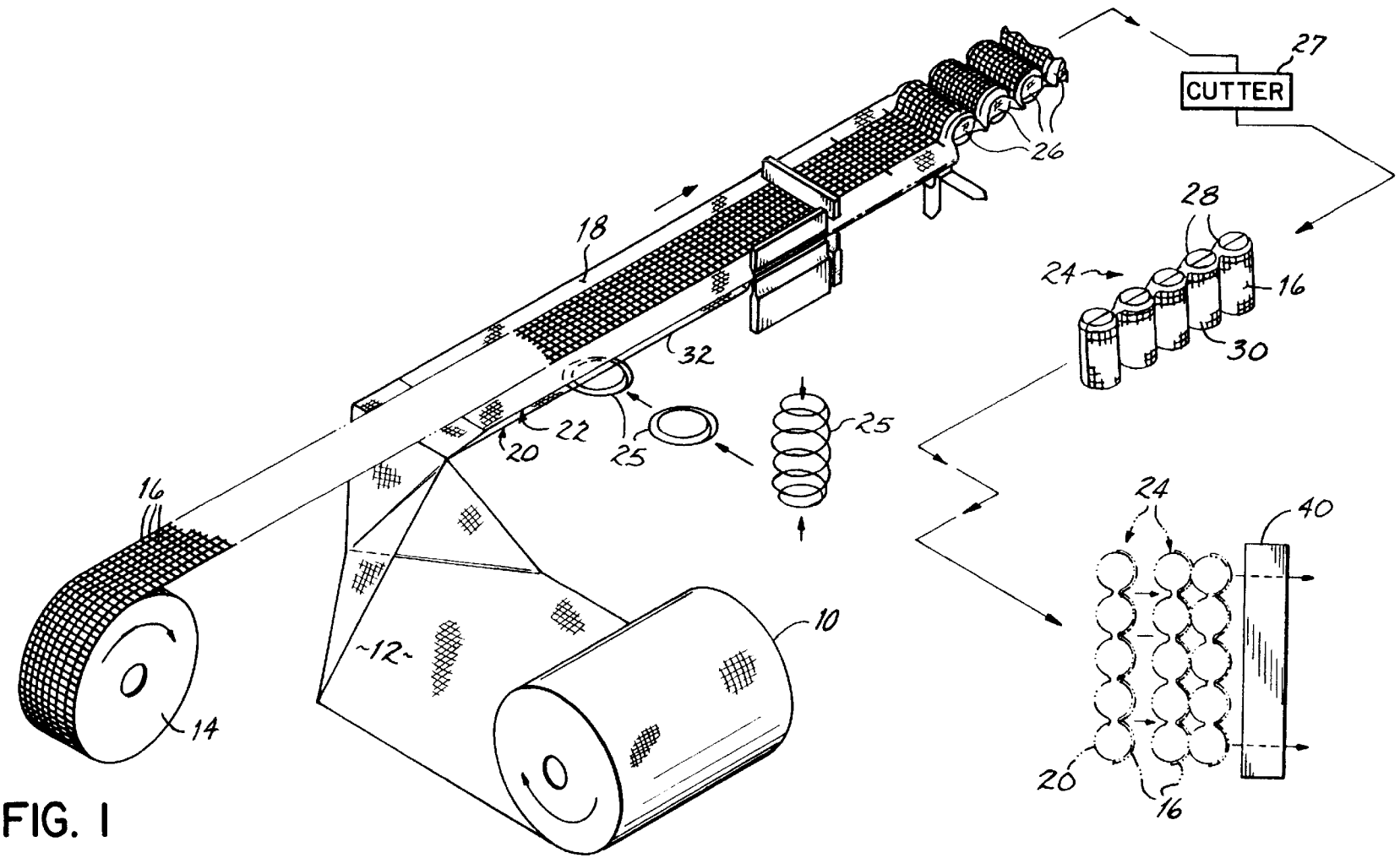
FIG. 1 is a perspective view of a schematic representation of one presently preferred method of the present invention for producing core assemblies consisting of strings of pocketed coil springs with a fabric and adhesive layer.
Figure 2:
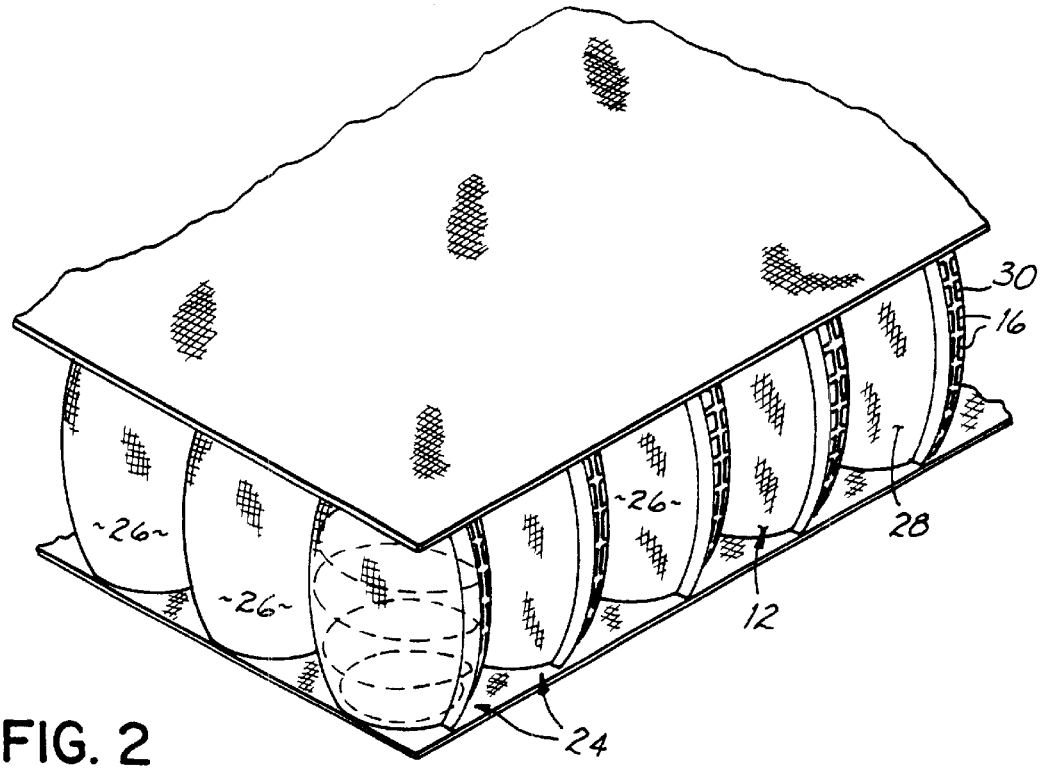
FIG. 2 is a perspective view of a product made by the method of the present invention.
Figure 3:
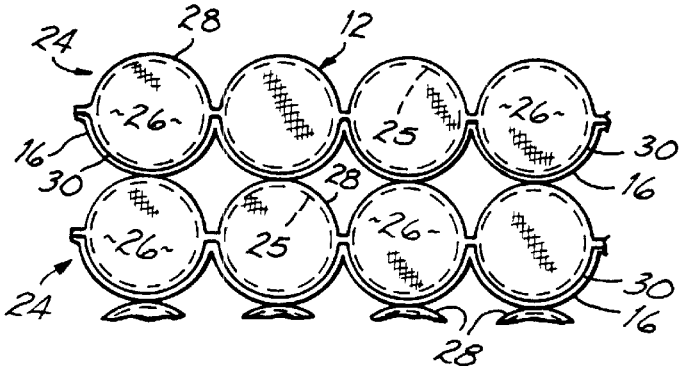
FIG. 3 is a top plan view of a core assembly according to the principles of the present invention.
Figure 4:
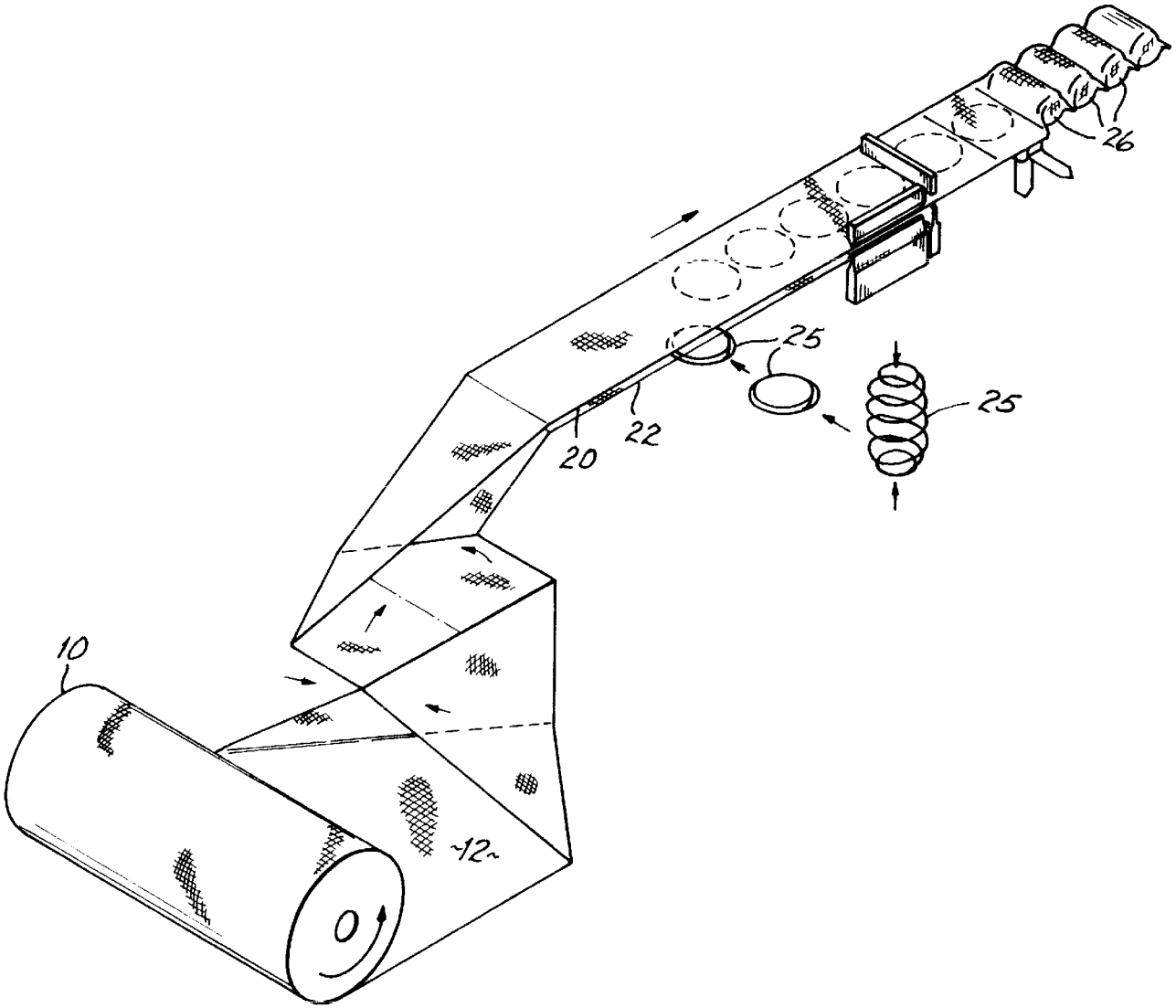
FIG. 4 is a perspective view of a schematic representation of an alternative method of the present invention for producing strings of pocketed coil springs with a fabric layer.

Referring to the drawings, FIG. 1 illustrates a presently preferred method of manufacturing pocketed coil springs into strings which may be assembled into cores for use in mattresses or the like according to the principles of the present invention. As illustrated, there is a first supply roll 10 about which a flexible, pocketing material 12 is disposed and a second supply roll 14 about which a preferably flexible, adhesive material 16 is disposed. The process is carried out as described above with respect to the prior art, but a layer of flexible, adhesive fabric material 16 is laid upon the outer surface 18 of one of the folds 20, 22 of the pocketing material 12. The resulting string 24 of encased coil springs 26, as shown in FIGS. 2 and 3, has on a first side 28 a layer of pocketing material 12, and on a second opposing side 30 a layer of, adhesive fabric material 16 over a layer of pocketing material 12. To form the mattress core, the encased coil springs 26 are cut by a cutter 27 into strings 24 having a desired number of encased coil springs 26, the strings 24 of pocketed coil springs 26 are aligned in columns with the coils 25 side by side, as shown in FIGS. 1, 2 and 3, or in a honeycomb alignment (not shown), with the second side 30 of one string 24 contacting the first side 28 of the adjacent string 24. Thus, between the rows of coil springs 25 there are two layers of pocketing material 12 and an intervening layer of flexible, fabric material 16. Heat or other activating means 40 is then applied to the assembly to activate the adhesive component of the adhesive material 16. An adhesive bond is thereby created between the first and second sides 28, 30 of adjacent strings 24.

The adhesive fabric material 16 may be any material with a preprinted pattern of an adhesive, such as glue, or may be a material saturated with an adhesive, or may be a material with an adhesive powder that impregnates the fabric. By way of example, the adhesive fabric material 16 may be a web of nonwoven fabric material reinforced with a heat sensitive mesh netting. One nonwoven material with the reinforced netting is sold under the registered trademark LAMINET® by Conwed Plastics of Minneapolis, Minn. This product includes both the nonwoven material and the heat-actuated adhesive netting, albeit the reinforced heat-actuated netting itself is also sold by this company under the registered trademark THERMANET®. The heat sensitive reinforced mesh or netting is a polypropylene plastic with the adhesive integral with the netting itself so as to form both a bonding agent and a reinforcement for the nonwoven. Furthermore, the web of adhesive may be in a mesh configuration or another known configuration within the scope of this invention.

The activating means 40 for the adhesive component may be an oven operated at temperatures high enough to melt the adhesive component, but low enough to prevent the material and pocketing material 12 from melting or burning. For example, the adhesive web on the LAMINET® product has a tack temperature of approximately 180° F. to 212° F. and a melt temperature between 200° F. and 284° F. Thus, the oven may be operated at a temperature of about 225° F. to effectively activate the adhesive component for bonding to the adjacent string of pocketed spring coils. Alternatively, the activating means 40 may be a heat lamp or a radiation emitting device.

Figure 5:
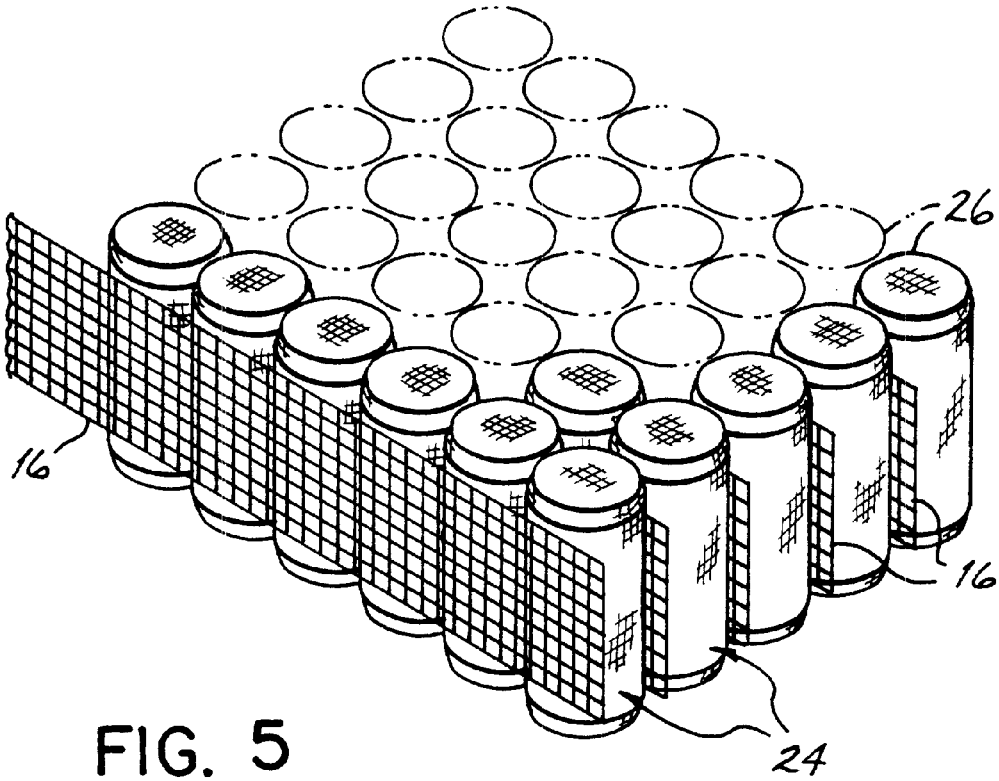
FIG. 5 is a perspective view of an alternative embodiment of a core assembly according to the principles of the present invention.
Figure 6:
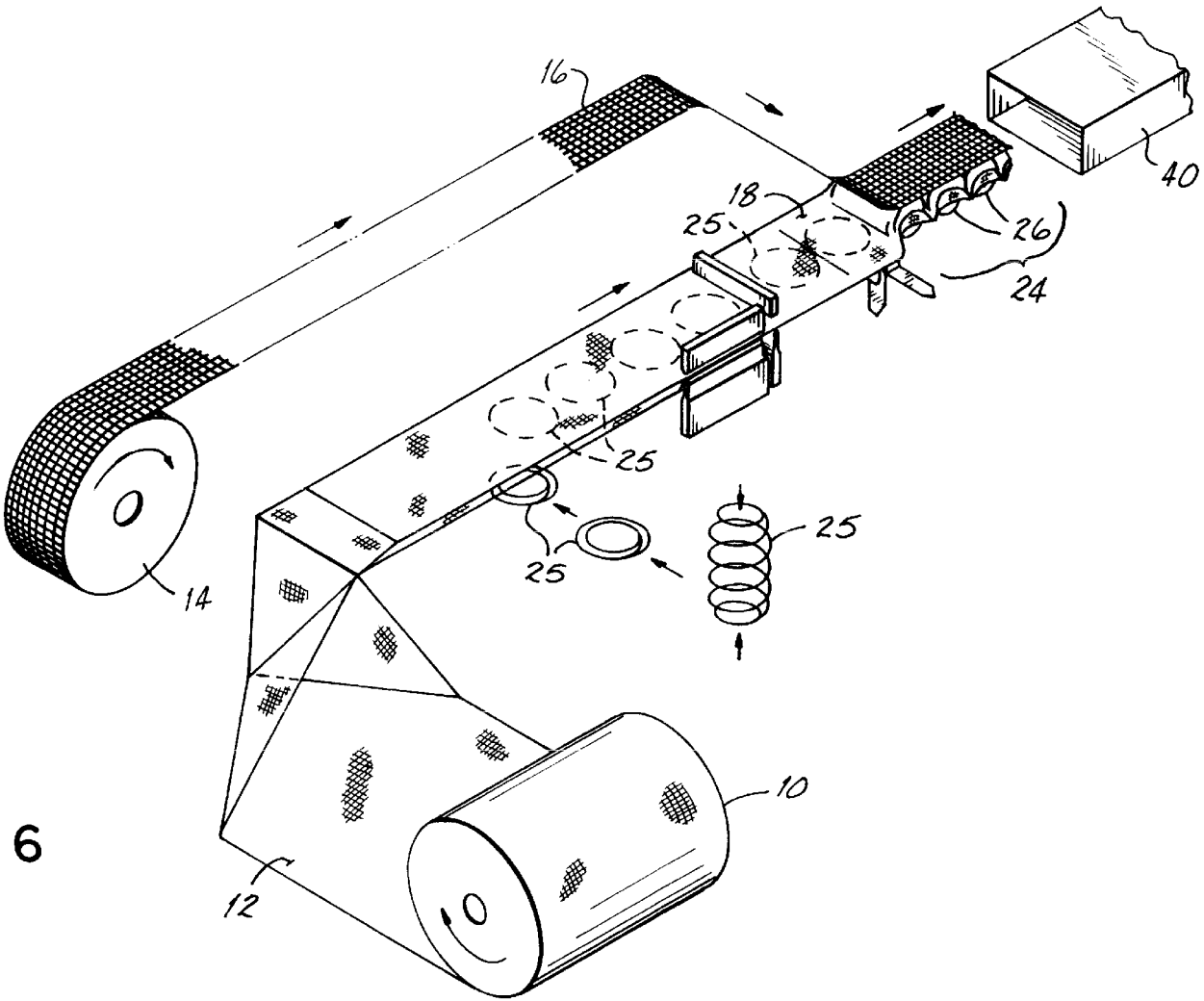
FIG. 6 is a perspective view of a schematic representation of an alternative presently preferred method of the present invention for producing core assemblies consisting of strings of pocketed coil springs with an adhesive layer.

Referring to FIGS. 5 and 6, an alternative preferred embodiment of this invention is shown in which the layer of material 16 is taut and interposed between the adjacent strings 24 and the strings are joined together. The layer 16 is taut and does not conform to the contour of the side surfaces 28, 30 of the pocketed coil springs 26 as compared to FIG. 3. Preferably, the layer 16 is applied to the string 24 after the springs 25 are inserted into the respective pockets, turned and expanded, as needed (FIG. 6). As such, the layer 16 is pulled taut from the supply roll 14 and maintained in a taut configuration. A tensioning device (not shown) may be positioned between the supply roll 14 and the point of application to the string 24 and utilized to maintain the layer 16 taut as would be readily understood by one skilled in this art. The layer 16 is preferably taut, but is not required to be entirely without wrinkles or precisely planar within the scope of this invention. Further, although the layer 16 is shown taut across the entire length of the string 24, it may be desirable to introduce a buckle between selected pocketed springs 25 or slack in the layer 16 at appropriate locations to afford expansion and/or contraction properties in a controlled manner at such locations. Moreover, the buckle or the like in the layer 16 may be aligned from string 24 to string 24, not included in some or all strings 24 or be offset from string 24 to string 24 as desired.

Preferably, the layer 16 is a fabric material which includes an adhesive component or is an adhesive netting. The fabric may be woven, nonwoven, knitted or of another construction. The adhesive may be incorporated into the fabric material in the form of netting or another embodiment. Examples layers 16 which can be used with this embodiment are products which include both the nonwoven material and the heat-actuated adhesive netting such as LAMINET®; alternatively, the reinforced heat-actuated adhesive netting itself is also sold under the registered trademark THERMA-NET®. Preferably, the layer 16 has low stretching properties so that the expansion and/or contraction of the layer 16 and strings 24 attached thereto is minimized to maintain the desired dimensional configurations of the string 24 and spring assembly.

The layer 16 is preferably adhesively bonded to the adjacent strings 24 and thereby adhesively joins the adjacent strings 24 together. If the layer 16 does not include an adhesive component, the adhesive may be applied to the layer 16 before, during or after application to the string 24 or the adhesive may be applied to the string 24 prior to attaching the taut layer 16. If the layer 16 includes an adhesive component, then the adhesive must be activated such as by processing through the activating means 40 which could be an oven operated at temperatures high enough to melt the adhesive component, but low enough to prevent the material and pocketing material 12 from melting or burning as previously described for the LAMINET®. Alternatively, the activating means 40 may be a heat lamp, a radiation emitting device or other appropriate mechanism.

The spring assembly is formed by juxtaposing the strings 24 to one another until the desired number of strings are assembled (FIG. 5). The spring assembly with the taut layer 16 between adjacent strings 24 minimizes, reduces and/or eliminates the expansion and/or contraction to result in a more precisely sized pocketed spring assembly.

Accordingly, the present invention provides a simple process that overcomes all of the aforesaid problems encountered in the prior art, and does so with reduced costs. The strings are adhered to one another in one embodiment by the adhesive component of the fabric material without the difficulties of the prior art methods, and expansion and contraction of the strings and resulting spring assembly is reduced or eliminated by the taut layer of fabric material between the adjacent strings.

Numerous alterations of the structure and process herein disclosed will suggest themselves to those skilled in the art. For example and without limitation, the fabric material may be any taut material which is adhered to the strings to limit their expansion and/or contraction. However, it is to be understood that the present disclosure relates to the preferred embodiments of the invention which are for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of making a spring assembly comprising:

encasing a plurality of coiled springs in individual pockets of material to form a string of pocketed coil springs with opposing outwardly facing surfaces;

juxtaposing a plurality of the strings of pocketed coil springs in side-by-side fashion with longitudinal axes of the springs being generally parallel to one another;

interposing a layer of material between adjacent strings of pocketed coil springs;

tautening the layer of material; and adhesively joining the adjacent strings of pocketed coil springs together with the layer of material therebetween.

2. The method of claim 1 wherein the material is a nonwoven fabric web with a preprinted pattern of a heat activated adhesive.

3. The method of claim 2 further comprising:

activating the adhesive on the fabric material to thereby adhere the fabric material to the strings and join the strings together.

4. The method of claim 1 wherein the layer of material is a fabric with an adhesive component.

5. The method of claim 1 wherein the layer of material further comprises a netting of adhesive.

6. The method of claim 1 wherein the layer of material covers a major portion of the facing surface of the string.

7. The method of claim 1, further comprising:

adding a layer of adhesive between adjacent strings of pocketed coil springs.

8. The method of claim 1 wherein the layer of fabric material is interposed between the adjacent strings of pocketed coil springs without conforming to the contour of the adjacent strings.

9. A method of making a spring assembly comprising:

encasing a plurality of coiled springs in individual fabric pockets to form a string of pocketed coil springs with opposing outwardly facing surfaces;

adding a layer of fabric material to at least one of the facing surfaces;

tautening the layer of fabric material;

adhesively joining the layer of fabric material to the at least one facing surface;

juxtaposing a plurality of the strings of pocketed coil springs in side-by-side fashion with longitudinal axes of the springs being generally parallel to one another, and with at least one outwardly facing surface of adjacent strings having the layer of fabric material; and adhesively joining the strings of pocketed coil springs together.

10. The method of claim 9 further comprising:

inserting the coiled springs in a compressed state through an opening between two plies of fabric;

sealing the fabric between adjacent coils and at the opening to form individual coil-spring containing fabric pockets; and turning the coils to permit expansion within the respective pockets.

11. The method of claim 9 wherein the fabric is sealed by thermal sealing.

12. The method of claim 11 further comprising:

activating the adhesive by heating.

13. The method of claim 9 wherein the fabric material is a web of nonwoven fabric with a preprinted pattern of a heat activated adhesive.

14. The method of claim 9 wherein the fabric material is a fabric saturated with an adhesive.

15. The method of claim 9 wherein the fabric material is a fabric impregnated with an adhesive powder.

16. A method of making a spring assembly comprising:

encasing a plurality of coiled springs in individual pockets of material to form a string of pocketed coil springs with opposing outwardly facing surfaces;

juxtaposing a plurality of the strings of pocketed coil springs in side-by-side fashion with longitudinal axes of the springs being generally parallel to one another;

interposing a layer of adhesive netting between adjacent strings of pocketed coil springs;

tautening the layer of adhesive netting; and joining the adjacent strings of pocketed coil springs together with the adhesive netting.

17. The method of claim 16 further comprising:

activating the adhesive netting to thereby adhere the adhesive netting to the strings and join the strings together.

18. The method of claim 16 wherein the layer of adhesive netting covers a major portion of the facing surface of the string.

19. A spring assembly comprising:

a plurality of strings of coiled springs in individual fabric pockets in side by side relation with longitudinal axes of the springs being generally parallel to one another; and a taut layer of fabric material between each adjacent pair of strings of coiled springs, the adjacent strings of coiled springs and the layer of fabric being adhesively joined together.

20. The spring assembly of claim 19 wherein the layer of fabric covers a major portion of a facing surface of the adjacent strings.

21. The spring assembly of claim 19 wherein the fabric material comprises an adhesive netting.

22. The spring assembly of claim 21 wherein the adhesive netting is polypropylene with adhesive integral with the netting.

23. The spring assembly of claim 19 wherein the taut layer of fabric between the adjacent pair of strings of coiled springs is generally linear and tangential to the respective fabric pockets of the adjacent strings.

24. The spring assembly of claim 23 wherein the taut layer has low stretching properties to thereby minimize the expansion of the adjacent strings.

25. A spring assembly manufactured from a method comprising:

encasing a plurality of coiled springs in individual pockets of material to form a string of pocketed coil springs with opposing outwardly facing surfaces;

juxtaposing a plurality of the strings of pocketed coil springs in side-by-side fashion with longitudinal axes of the springs being generally parallel to one another;

interposing a layer of fabric material between adjacent strings of pocketed coil springs;

tautening the layer of fabric material; and adhesively joining the adjacent strings of pocketed coil springs together with the layer of fabric therebetween.

26. The spring assembly of claim 25 wherein the fabric material comprises an adhesive netting.

27. A method of making a spring assembly from a plurality of strings of pocketed coil springs with opposing outwardly facing surfaces, the method comprising:

juxtaposing a plurality of the strings of pocketed coil springs in side-by-side fashion with longitudinal axes of the springs being generally parallel to one another;

interposing a layer of fabric material between adjacent strings of pocketed coil springs;

tautening the layer of fabric material; and adhesively joining the adjacent strings of pocketed coil springs together with the layer of fabric therebetween.

28. The method of claim 27 wherein the fabric material comprises an adhesive netting.

* * * * *